US007255504B2

(12) United States Patent
Kim

(10) Patent No.: US 7,255,504 B2
(45) Date of Patent: Aug. 14, 2007

(54) PAPER DETECTING APPARATUS AND IMAGE FORMING APPARATUS HAVING THE SAME

(75) Inventor: Myoung-jin Kim, Incheon (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 11/320,244

(22) Filed: Dec. 29, 2005

(65) Prior Publication Data

US 2006/0228152 A1 Oct. 12, 2006

(30) Foreign Application Priority Data

Apr. 7, 2005 (KR) ..... 10-2005-0028807

(51) Int. Cl.
*B41J 11/58* (2006.01)
*B41J 13/10* (2006.01)

(52) U.S. Cl. ..... 400/624; 271/145

(58) Field of Classification Search ..... 400/624; 271/145

See application file for complete search history.

(56) References Cited

U.S. PATENT DOCUMENTS

2005/0035535 A1* 2/2005 Ogata et al. ..... 271/220

FOREIGN PATENT DOCUMENTS

| | | | |
|---|---|---|---|
| JP | 08-198518 | | 8/1996 |
| JP | 2000-109224 | | 4/2000 |
| JP | 2000-327174 | | 11/2000 |
| JP | 2004-026393 | * | 1/2004 |
| JP | 2004-035181 | | 2/2004 |
| JP | 2004-123365 | | 4/2004 |
| KR | 20-0124530 | | 6/1998 |
| KR | 1020000026593 | | 5/2000 |

* cited by examiner

*Primary Examiner*—Daniel J. Colilla
*Assistant Examiner*—Marissa Ferguson-Samreth
(74) *Attorney, Agent, or Firm*—Roylance, Abrams, Berdo & Goodman, L.L.P.

(57) ABSTRACT

A paper detecting apparatus and an image forming apparatus having the same are disclosed. The paper detecting apparatus has a sensor unit installed in the main body of the image forming apparatus. The location of the paper detecting apparatus is varied according to the size of printing paper so as to be able to detect the presence or absence of printing paper loaded in the feed cassette. The presence or absence of printing paper is detected at the rear end portion of the printing paper. A sensor location varying unit varies the location of the sensor unit for detecting paper according to the size of printing paper such that the sensor unit can detect the printing paper at the rear end portion of the printing paper irrespective of the size of the printing paper loaded in the feed cassette. The paper detecting apparatus has a simple construction and can detect the presence or absence of printing paper at the rear end of the paper irrespective of the size of the paper, thus preventing developer from being unnecessarily consumed due to starting the developing operation in spite of the absence of the printing paper.

20 Claims, 7 Drawing Sheets

PAPER DETECTING APPARATUS AND IMAGE FORMING APPARATUS HAVING THE SAME

CROSS-REFERENCE TO RELATED APPLICATIONS

This application claims the benefit under 35 U.S.C. § 119(a) of Korean Patent Application No. 2005-28807, filed on Apr. 7, 2005, the entire contents of which are hereby incorporated by reference.

BACKGROUND OF THE INVENTION

1. Field of the Invention

The present invention relates to an image forming apparatus. More particularly, the present invention relates to an improved paper detecting apparatus for detecting the presence or absence of printing paper in a feed cassette of the image forming apparatus, and an image forming apparatus having the same.

2. Description of the Related Art

In general, a color image forming apparatus with a printing function, such as a laser printer, a copier, a facsimile, or a multifunction peripheral, has the following configuration. With reference to FIG. 1, an image forming apparatus has a plurality of color-specific photosensitive media 12, 13, 14 and 15 inside the main body 100 of the image forming apparatus. A plurality of laser scanning units (LSU) 22, 23, 24 and 25 irradiate a laser beam to the respective photosensitive media to form electrostatic latent images on the photosensitive media. A plurality of developing units 32, 33, 34 and 35 supply developing solution to the respective photosensitive media with the electrostatic latent images to form a visual image. The visual images formed on the respective photosensitive media are transferred and superimposed upon one another on an intermediate transferring medium 50 by a plurality of first transferring units 42, 43, 44 and 45. The final images formed on the intermediate transferring medium 50 are transferred to a printing paper P supplied by a second transferring roller 60. The final images transferred to the printing paper P are fixed by a fixing unit 70 that applies high-temperature heat and pressure to the images. The printing paper is then discharged outside the image forming apparatus. In the lower part of the main body 100 of the image forming apparatus, a feed cassette 110 supplies sheets of printing paper inside the main body 100 of the image forming apparatus. Furthermore, the image forming apparatus has a paper detecting sensor or the like to sense whether printing paper is loaded in the feed cassette. If there is no printing paper, the paper detecting sensor sends a signal to a controller of the image forming apparatus, thereby stopping the printing operation and alarming users.

FIG. 2 shows a conventional paper detecting system. The paper detecting system comprises a paper plate 120 having one end fixedly installed to the feed cassette 110, a biasing spring 130 that elastically biases the paper plate 120 to a pickup position, and a pickup roller 140 picking up the printing paper loaded on the paper plate 120 to deliver the printing paper inside the main body 100 of the image forming apparatus. A paper guide lever 150 regulates the distance between the top and bottom of the sheets of printing paper stacked in the paper plate 120, while sliding along a guide groove (not shown) formed on the bottom surface of the feed cassette 110.

A paper detecting sensor 160 is installed in the main body 100 of the image forming apparatus to be located at the upper front end of the paper plate 120, thus detecting whether printing paper is stacked on the paper plate 120 and sending a detected signal. The paper plate 120 is formed with a paper plate groove at a position corresponding to the paper detecting sensor 160.

Thus, when the last sheet of printing paper remains on the paper plate 120, the paper detecting sensor 160 detects the printing paper by receiving light 161 reflected from the paper. When the last sheet loaded on the paper plate 120 is printed out and the rear end of the printing paper moves out of a detecting area of the paper detecting sensor 160, the paper detecting sensor 160 does not sense the light because the light 162 passes through the paper plate groove (not shown) formed on the paper plate 120, and thus concludes that there is no printing paper.

In a tandem-type color image forming apparatuses, the laser scanning units 22 to 25 irradiate a laser beam on the photosensitive media 12 to 15 before a sheet of paper in the feed cassette is picked up by the pickup roller 140. This is to increase the printing output rate of the system.

Thus, when continuous printing output is carried out and the number of sheets to be printed is more than the number of sheets of printing paper loaded in the feed cassette, the lack of printing paper is detected after the laser beam has already irradiated the photosensitive media and development has begun. Accordingly, developing agent is consumed unnecessarily. Also, since images on the photosensitive media 12 to 15 and the intermediate transferring medium 50 have to be cleaned, the cleaning load is increased. Further, the second transferring roller 60 is contaminated; hence, when outputting the next sheet after loading new sheets of printing paper, the backside of the sheet is contaminated.

To address these problems, a paper detecting system installed with the paper detecting sensor 160 at an upper part of the rear end of the paper plate 120 has been developed. This paper detecting system alleviates some of the described problems, but introduces other problems. In particular, the length of printing paper that can be used is limited because the paper detecting sensor 160 is fixed.

To address this problem, the paper detecting sensor 160 may be installed on a paper guide lever 150. If this is done, however, because the feed cassette is separated from the main body of the image forming apparatus, a separate connector needs to exchange signals between the paper detecting sensor and the controller installed in the main body of the image forming apparatus. Furthermore, when mounting the feed cassette to the image forming apparatus, the connector has to be connected to the controller. Accordingly, the paper detecting system as mentioned above is inconvenient for a user.

Accordingly, there is a need for an improved detector for detecting the presence of paper in a paper feed cassette for an image forming apparatus, and an image forming apparatus having the same.

SUMMARY OF THE INVENTION

An aspect of the present invention is to address at least the above problems and/or disadvantages and to provide at least the advantages described below. Accordingly, an aspect of the present invention is to provide a paper detecting apparatus that has a paper detecting sensor which varies the detecting location according to the size of printing paper, and thus can detect the presence of printing paper by sensing a certain portion of the rear end of the printing paper at all times, irrespective of the size of the printing paper to be used.

Another aspect of the present invention is to provide a paper detecting apparatus that has a simple construction.

Yet another aspect of the invention is to provide an image forming apparatus that has a paper detecting apparatus having the above-mentioned features.

In accordance with an aspect of the invention, the paper detecting apparatus according to an exemplary embodiment of the present invention comprises a sensor unit and a sensor location varying unit. The sensor unit is installed in the main body of the image forming apparatus and has a variable location for detecting paper according to the size of printing paper so as to be able to detect the presence of printing paper loaded in the feed cassette at the rear end portion of the printing paper. The sensor location varying unit varies the location of the sensor unit according to the size of the printing paper such that the sensor unit can detect the printing paper at the rear end portion of the printing paper irrespective of the size of the printing paper loaded in the feed cassette.

The sensor location varying unit may cause the location of the sensor unit to be varied in association with an operation of mounting the feed cassette to the image forming apparatus.

The sensor location varying unit may include a paper guide lever that moves longitudinally according to the length of the printing paper loaded in the feed cassette, and a sensor guide link member that rotates about a first end thereof in association with movement of the paper guide lever so that the sensor guide link member pushes the sensor unit by contacting the sensor unit when the feed cassette is mounted to the image forming apparatus.

Furthermore, the sensor guide link member may be pivotably coupled to an axis on the bottom surface of the feed cassette at the first end of the sensor guide link member, and a longitudinal guide slit may be formed at a second end of the sensor guide link. The paper guide lever may have a guide protrusion which is inserted into the guide slit such that the sensor guide link member rotates about the axis depending on the movement of the paper guide lever.

The sensor unit may include a paper detecting sensor, a sensor support for supporting the paper detecting sensor and for moving in contact with the sensor guide link member along a sensor guide rail installed in the main body of the image forming apparatus, and an elastic member for elastically biasing the sensor support toward an initial location.

In addition, in accordance with another aspect of the present invention, an image forming apparatus comprises a main body that includes a printing engine for forming an image and a feed means for feeding printing paper to the printing engine. A feed cassette is removably mounted in the main body of the image forming apparatus and is capable of being loaded with a variety of different sizes of printing paper. A sensor unit is installed in the main body of image forming apparatus and varies the location for detecting paper according to the size of printing paper so as to be able to detect the presence or absence of printing paper loaded in the feed cassette at the rear end portion of the printing paper. A sensor location varying unit varies the location of the sensor unit according to the size of printing paper in association with the mounting of the feed cassette, such that the sensor unit can always detect the printing paper at the rear end portion of the paper irrespective of the size of the printing paper loaded in the feed cassette.

The sensor location varying unit may include a paper guide lever that moves longitudinally to adjust for the length of different sizes of printing paper loaded in the feed cassette. A sensor guide link member rotates about a first end thereof in association with the movement of the paper guide lever, thereby pushing the sensor unit by contacting the sensor unit when the feed cassette is mounted to the image forming apparatus.

The sensor unit may include a paper detecting sensor, a sensor support for supporting the paper detecting sensor, a sensor guide rail installed in the main body of the image forming apparatus to guide movement of the sensor support, and an elastic member for elastically biasing the sensor support toward an initial location.

BRIEF DESCRIPTION OF THE DRAWINGS

The above and other objects, features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
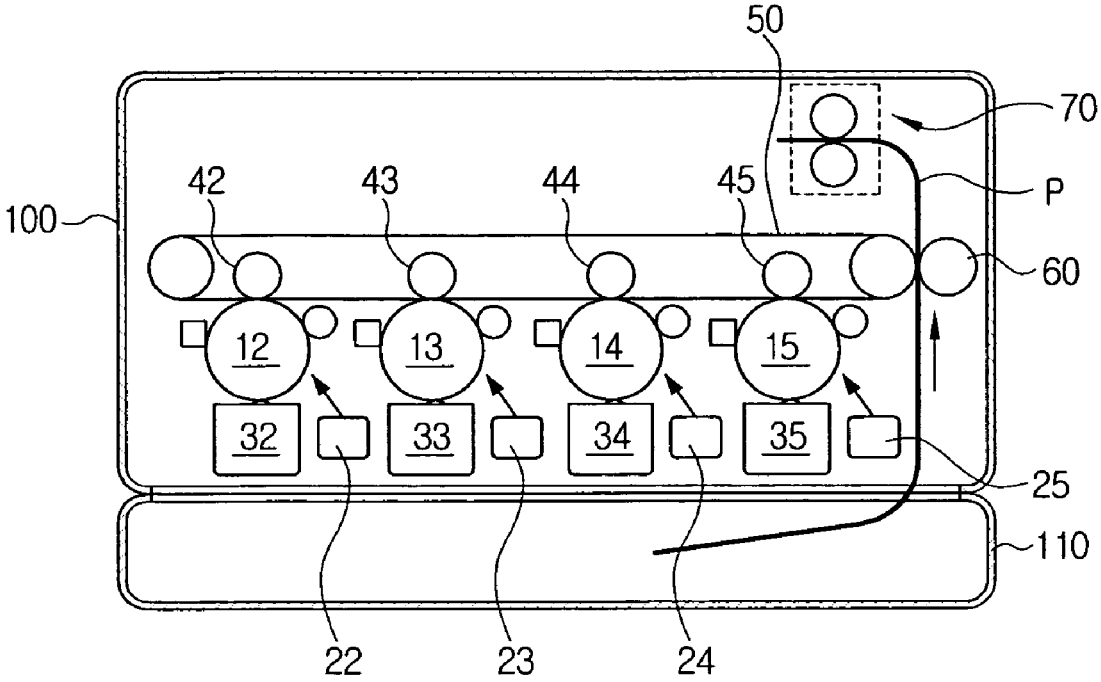
FIG. 1 (PRIOR ART)
FIG. 1 is a sectional side view showing the construction of a conventional color image forming apparatus.
Figure 2:
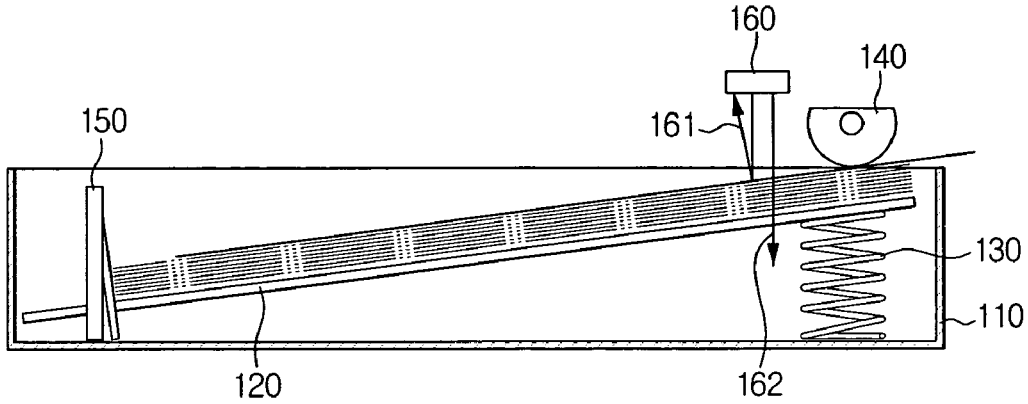
FIG. 2 (PRIOR ART)
FIG. 2 is a sectional side view showing the construction of a paper detecting apparatus employed by the color image forming apparatus of FIG. 1.

The paper detecting apparatus and the image forming apparatus having the same according to an exemplary embodiment of the present invention will be explained in detail with reference to the accompanying figures. However, the components of the image-forming apparatus other than the paper detecting apparatus (that is, the components such as a printing engine for forming an image including the photosensitive media 12 to 15, the laser scanning units 32 to 35 or the like, feed means such as the pickup roller 160 for feeding printing paper to the printing engine or the like) are substantially the same as the conventional image forming apparatus shown in FIG. 1. Thus, the description of such components will be omitted.

Figure 3:
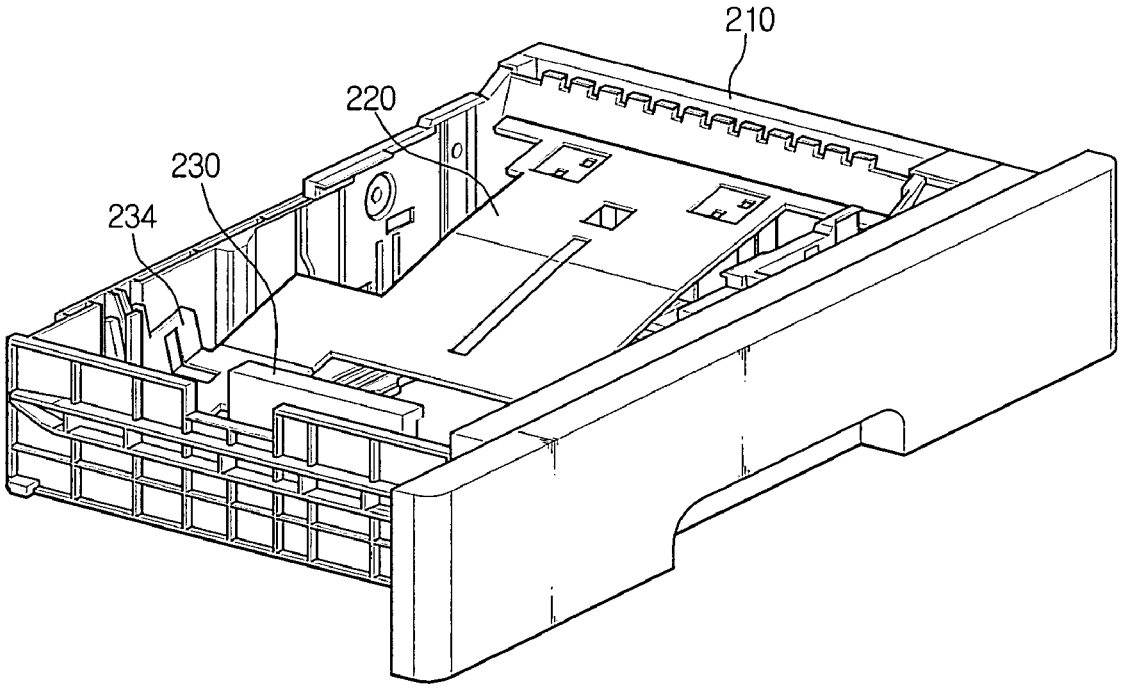
FIG. 3 is a perspective view of a paper detecting apparatus according to an exemplary embodiment of the present invention.
Figure 4:
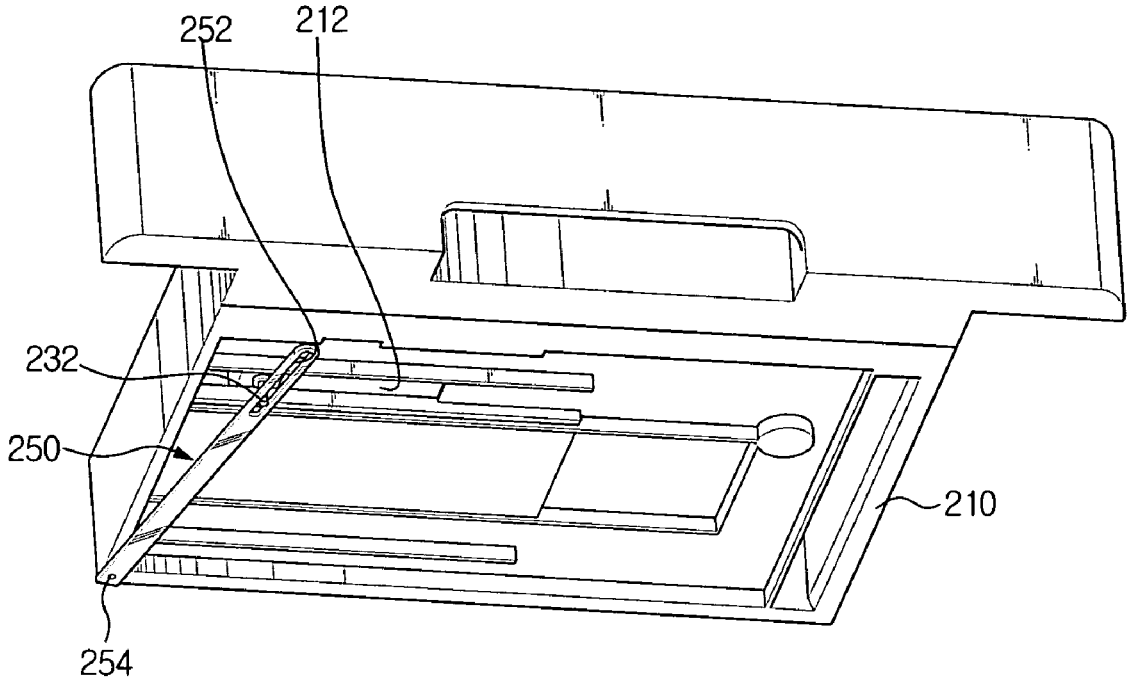
FIG. 4 is a front perspective view of the paper detecting apparatus shown in FIG. 3.
Figure 6:
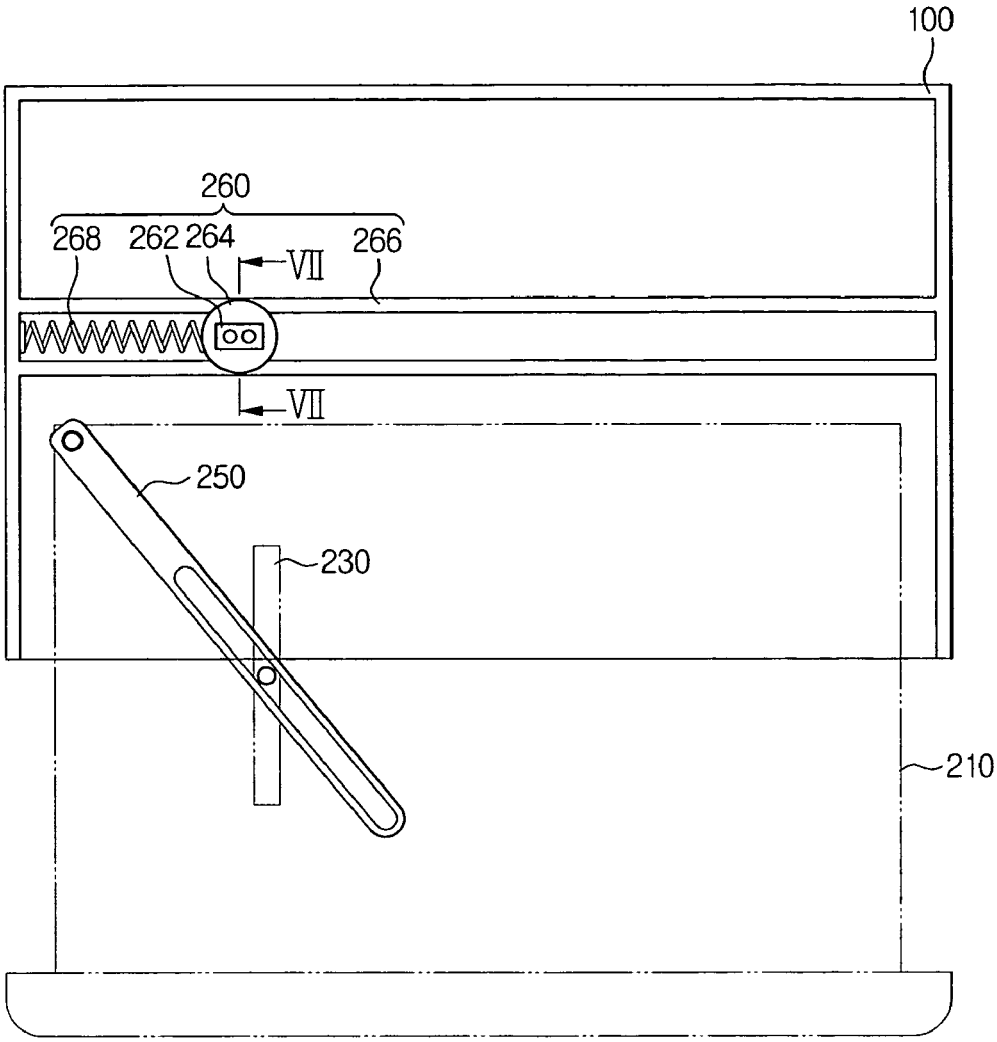
FIG. 6 is a plan view of a sensor unit according to an exemplary embodiment of the present invention.

A paper detecting apparatus includes a sensor location varying unit installed in a feed cassette 210 and a sensor unit 260 installed in a main body 100 of the image forming apparatus (see FIG. 6). Referring to FIGS. 3 and 4, the sensor location varying unit includes a paper guide lever 230 and a sensor guide link member 250, which are installed on the feed cassette 210.

The feed cassette 210 is provided with a storage space capable of storing printing papers, and has a paper plate 220 stacked with printing paper. The paper plate 220 has one end pivotably coupled to the feed cassette 210 so that the other end of the paper plate can be moved upward and downward.

The paper guide lever 230 is installed on the top side of the paper plate 220, and moves longitudinally to adjust for the length of the printing paper stacked on the paper plate 220. The paper guide lever 230 slides along a lever guide groove 212 formed on the bottom surface of the feed cassette 210. Moreover, the paper guide lever 230 has a guide protrusion 232 at the lower end of the paper guide lever. The guide protrusion 232 is inserted in a guide slit 252 formed on the sensor guide link member 250. Further, right-side and left-side width adjusting levers 234 are installed on both side of the paper plate 220. The adjusting levers 234 move transversely to adjust for the width of the printing paper stacked on the paper plate 220.

Figure 5:
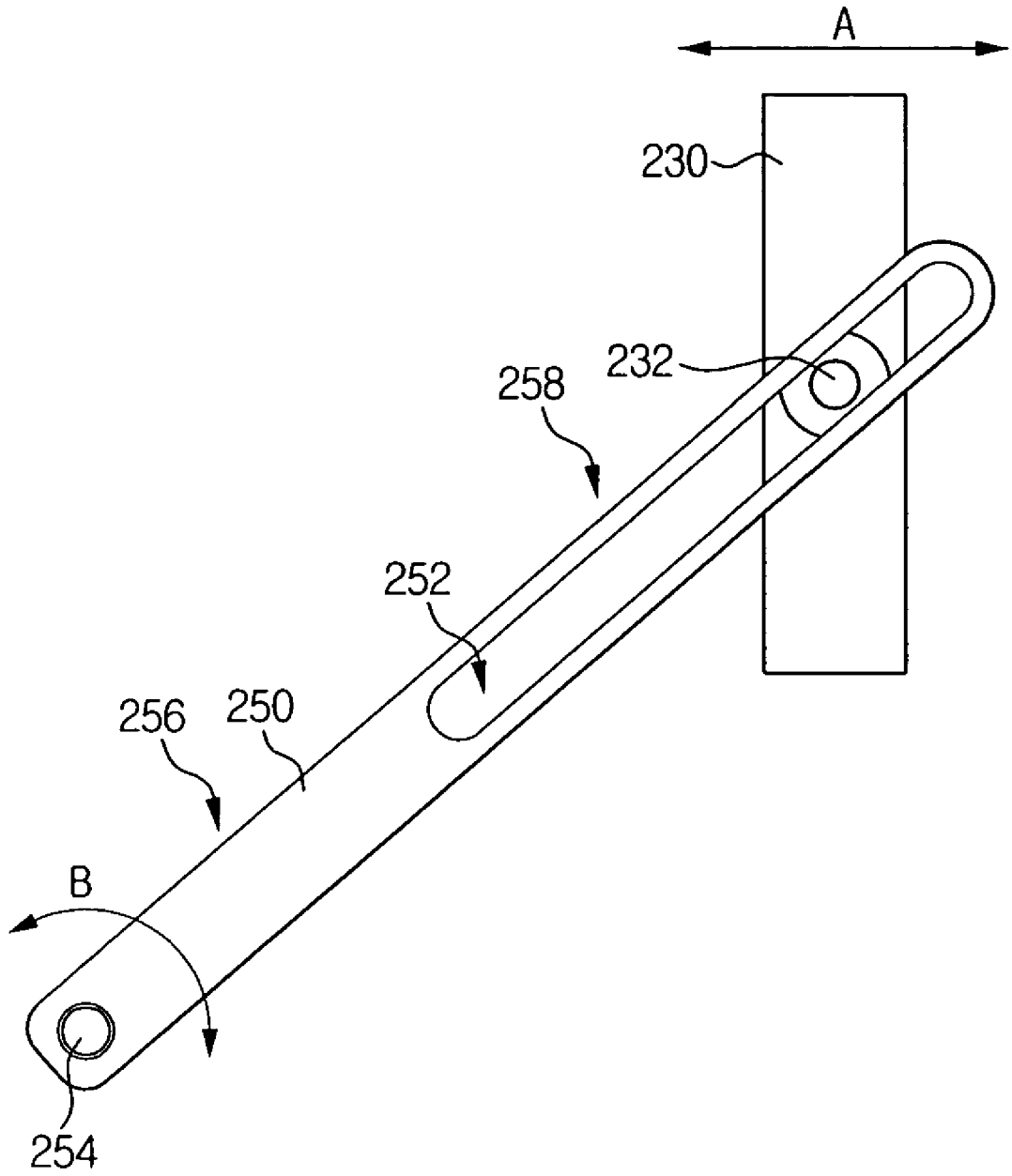
FIG. 5 is a view for explaining the operation of a sensor location varying unit according to an exemplary embodiment of the present invention.

With reference to FIG. 5, The sensor guide link member 250 has a first end 256 and a second end 258. The first end 256 of the sensor guide link member 250 is coupled to a hinge axis 254 on the bottom surface of the feed cassette 210 (see FIG. 4) so that the guide link 250 can rotate about the hinge axis 254. The second end 258 of the sensor guide link member 250 is formed with the longitudinal guide slit 252. The guide protrusion 232 of the paper guide lever 230 is moveably inserted in the guide slit 252.

The paper guide lever 230 moves along the lever guide groove 212 (see FIG. 4) as indicated by the arrow A, depending on the size of the printing paper to be stacked on the paper plate 210. Thus, the guide protrusion 232 moves along the guide slot 252. Thus, the sensor guide link member 250 is subjected to force by the guide protrusion 232 and also moves. As a result, the sensor guide link member 250 is rotated about the hinge axis 254 as indicated by the arrow B in association with the movement of the paper guide lever 230.

Figure 7:
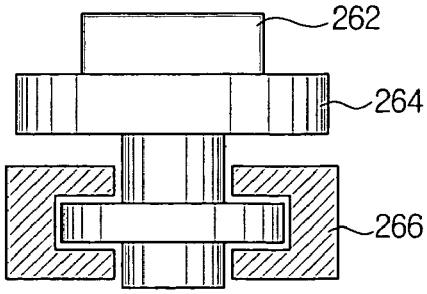
FIG. 7 is a sectional view taken along line VII-VII in FIG. 6.

With reference to FIGS. 6 and 7, the sensor unit 260 comprises a paper presence detecting sensor 262, a sensor support 264, a sensor guide rail 266 and an elastic member 268. The sensor unit 260 moves by means of the sensor guide link member 250 when the feed cassette 210 is mounted to the main body 100 of the image forming apparatus, thereby detecting whether printing paper is present at the rear end portion of the paper plate 220, irrespective of the size of the printing paper.

A sensor such as a photo coupler having a light emitting diode and a light receiving portion may be used as the paper detecting sensor 262. The paper detecting sensor 262 detects whether printing paper is present by sensing the rear end of the printing paper when the feed cassette 210 is mounted to the main body 100 of the image forming apparatus. The paper detecting sensor 262 is connected to communicate a signal with a controller (not shown) installed within the main body 100 of the image forming apparatus, and transmits the detected signal to the controller. The sensor support 264 moves in the longitudinal direction of the image forming apparatus. That is, the sensor support 264 moves along the substantially longitudinal sensor guide rail 266. A first end of the elastic member 268 is connected to the image forming apparatus and a second end of the elastic member is connected to the sensor support 264, so that the sensor support 264 is elastically biased to an initial location. In other words, the elastic member biases the sensor support 264 toward the main body 100 of the image forming apparatus.

Further, the sensor support 264 moves in contact with the sensor guide link member 250, when the feed cassette 210 is mounted to the main body 100 of the image forming apparatus. Thus, the paper detecting sensor 262 installed on the sensor support 264 moves depending on the location of the sensor guide link member 250.

Figure 8:
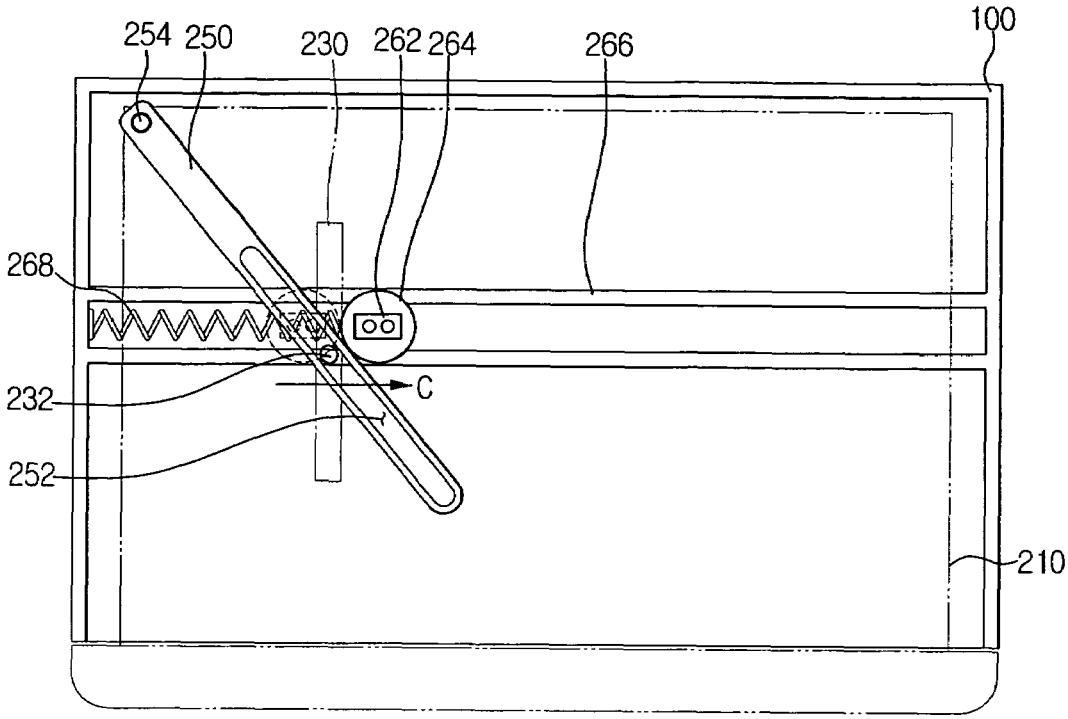
FIG. 8 is a plan view showing the state where a feed cassette has been mounted to the main body of an image forming apparatus.
Figure 9:
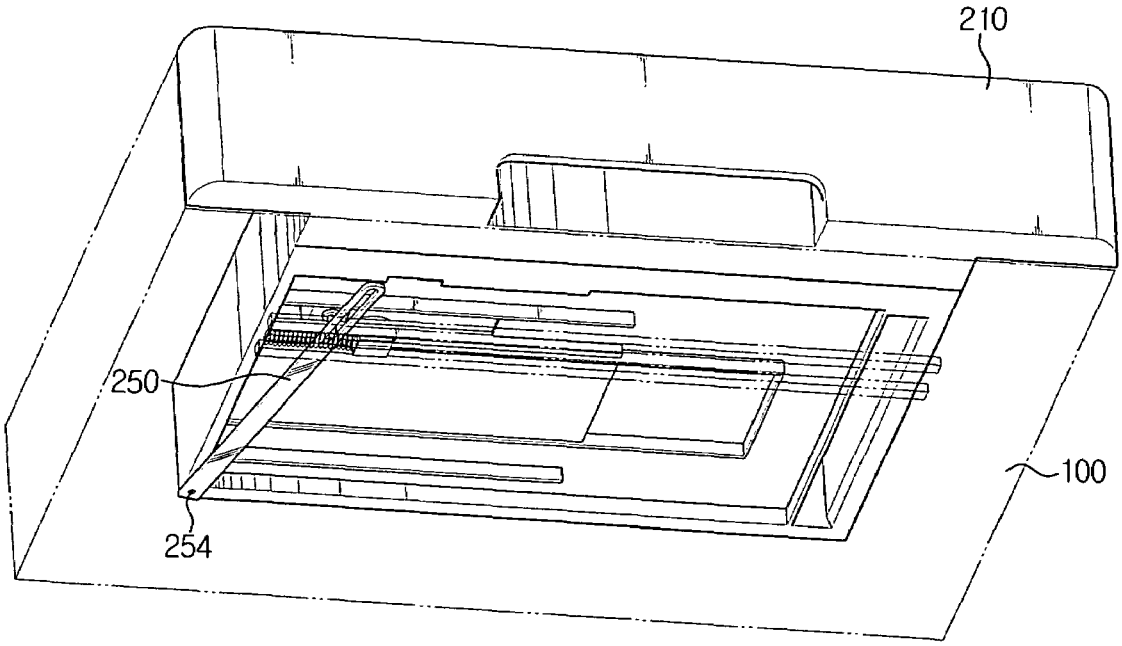
FIG. 9 is a front perspective view of certain elements of FIG. 8.
Figure 10:
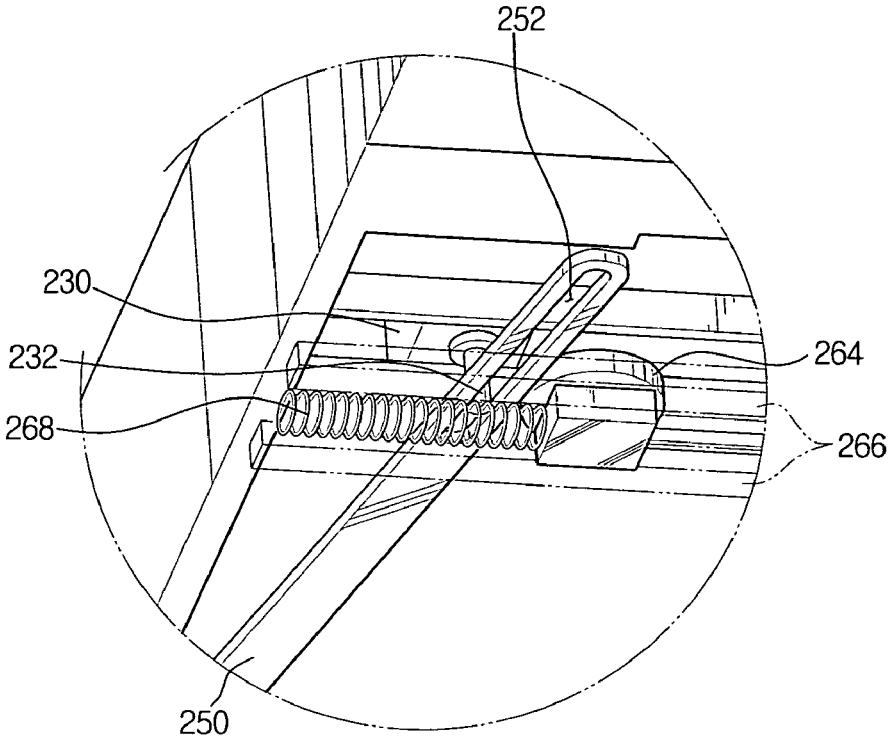
FIG. 10 is a enlarged view of a portion of FIG. 9.

The operation of the paper detecting apparatus according to the exemplary embodiment of the present invention will be explained. FIG. 8 is a plan view showing the state where the feed cassette 210 has been completely mounted in the main body 100 of the image forming apparatus; FIG. 9 is a rear perspective view showing the state in which the feed cassette 210 has been completely mounted in the main body 100 of the image forming apparatus; and FIG. 10 is an enlarged view showing a portion of FIG. 9.

After stacking printing papers on the paper plate 220, the paper guide lever 230 moves depending on the size of the stacked printing papers. At this time, the guide protrusion 232 moves along the guide slit 252 as mentioned above. Thus, the sensor guide link member 250 rotates about the hinge axis 254 in association with movement of the paper guide lever 230. After finishing the loading of the printing paper, the feed cassette 210 is slidably mounted in the main body 100 of the image forming apparatus.

While mounting the feed cassette 210, the sensor guide member 250 contacts the sensor support 264 located at the initial location (shown in a dotted line, see FIG. 8) with the paper detecting sensor being mounted. The sensor support 264 forced by the sensor guide link member 250 is pushed and moves along the sensor guide rail 266 in the direction indicated by the arrow C as the feed cassette 210 is further inserted toward the inside of the main body 100 of the image forming apparatus. When the feed cassette 210 is completely mounted in the main body 100 of the image forming apparatus, the sensor support 264 moves to the final location (shown in a solid line, see FIG. 8). The final location is the proper location for the paper detecting sensor 262 to sense the rear end of the printing paper.

That is, when the feed cassette 210 is mounted in the main body 100 of the image forming apparatus, the sensor guide link member 250 moves in association with the movement of the paper guide lever 230 according to the size of the printing paper. While the feed cassette 210 is mounted in the main body 100 of the image forming apparatus, the sensor support 264 mounted with the paper detecting sensor 262 moves by means of the sensor guide link member 250, and is finally located below the paper guide lever 230. When the feed cassette 210 is removed from the main body 100 of the image forming apparatus, the sensor support 264 is returned to the initial location by the elastic member 268 because no external forces are applied to the sensor support 264.

Figure 11:
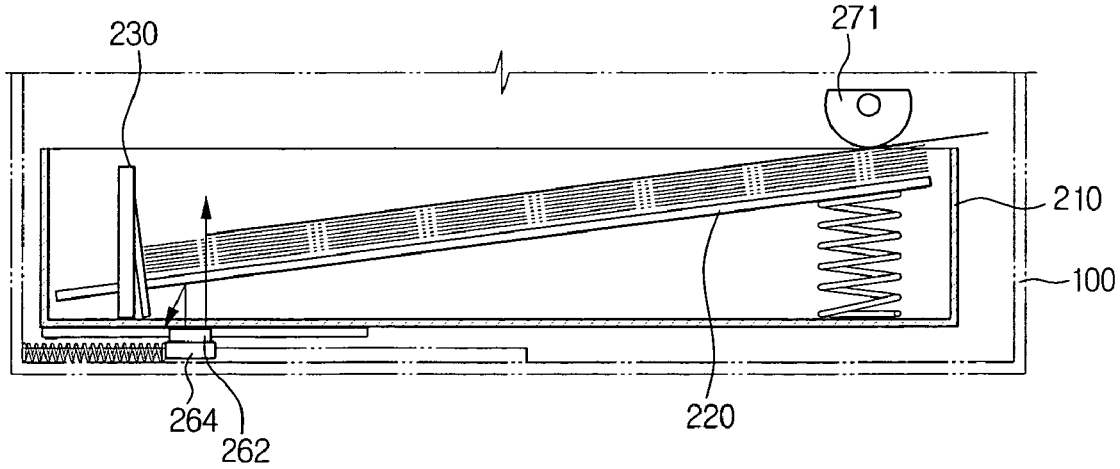
FIG. 11 is a sectional view of a paper detecting apparatus according to an exemplary embodiment of the present invention.

Accordingly, as shown in FIG. 11, the paper detecting sensor 262 mounted on the sensor support 264 can sense the rear end of the printing paper stacked on the paper plate 220. During the printing operation, the paper detecting sensor 262 senses the absence of printing paper directly after the last sheet of paper is picked by the pick-up roller 271. At this time, the operation of recording an image to be transferred to the last sheet of printing paper on the photosensitive media 12 to 15 (see FIG. 1) and the intermediate transferring medium 50 has not yet been started. The image forming apparatus recognizes the absence of the printing paper and stops the recording of the image, thus preventing the unnecessary consumption of developer.

As mentioned above, the paper detecting apparatus and the image forming apparatus with the same according to the present invention can detect the presence or absence of printing paper at the rear end of the paper, thereby detecting the presence or absence of the printing paper as soon as the printing paper is picked up. Thus, the paper detecting apparatus prevents the unnecessary consumption of developer caused by starting the developing operation of the photosensitive media despite the absence of printing paper. Furthermore, the paper detecting apparatus according to the exemplary embodiment of the present invention may detect the presence or absence of printing paper at the rear end of the paper irrespective of the size of the paper by the cooperation of the paper detecting sensor with the paper guide lever and the sensor guide link member.

While the invention has been shown and described with reference to certain embodiments thereof, it will be understood by those skilled in the art that various changes in form and details may be made therein without departing from the spirit and scope of the invention as defined by the appended claims.

What is claimed is:

1. A paper detecting apparatus for detecting printing paper within a feed cassette mounted to a main body of an image forming apparatus, comprising:

a sensor unit installed in the main body of the image forming apparatus to detect the presence or absence of printing paper, said sensor unit being movably mounted to said main body; and a sensor location varying unit mounted in said feed cassette for varying a location of the sensor unit according to the size of the printing paper such that the sensor unit can detect the printing paper at the rear end portion of the printing paper irrespective of the size of the printing paper loaded in the feed cassette.

2. The paper detecting apparatus as claimed in claim 1, wherein the sensor location varying unit causes the location of the sensor unit to be varied when the feed cassette is mounted to the image forming apparatus.

3. The paper detecting apparatus as claimed in claim 2, wherein the sensor location varying unit includes:

a paper guide lever that moves longitudinally according to the length of the printing paper loaded in the feed cassette; and a sensor guide link member with a first and a second end, the sensor guide link member rotating about the first end in association with movement of the paper guide lever, thereby pushing out the sensor unit by contacting the sensor unit when the feed cassette is mounted to the image forming apparatus.

4. The paper detecting apparatus as claimed in claim 3, wherein the first end of the sensor guide link member is pivotably coupled to an axis on the bottom surface of the feed cassette.

5. The paper detecting apparatus as claimed in claim 4, wherein a longitudinal guide slit is formed on the second end of the sensor guide link member, and the paper guide lever has a guide protrusion inserted into the guide slit so that the sensor guide link member rotates about the axis depending on the movement of the paper guide lever.

6. The paper detecting apparatus as claimed in claim 3, wherein the sensor unit includes:

a paper detecting sensor;

a sensor support for supporting the paper detecting sensor and for moving in contact with the sensor guide link member along a sensor guide rail installed in the main body of the image forming apparatus; and an elastic member for elastically biasing the sensor support toward an initial location.

7. The paper detecting apparatus of claim 1, wherein said sensor unit is slidably mounted in a track in the main body and movable in a linear path, and where said sensor location varying unit contacts said sensor unit when the feed cassette is positioned in said main body to move the sensor unit to a selected position corresponding to a selected paper size.

8. The paper detecting apparatus of claim 7, wherein said sensor location varying unit includes a guide link member that is movable to a position corresponding to the selected paper size, and where the guide link member contacts the sensor unit to move the sensor unit to the selected position when said feed cassette is mounted to the main body.

9. The paper detecting apparatus of claim 7, wherein said feed cassette is movable between a first position and a second position where said sensor location varying unit contacts and moves said sensor unit.

10. The paper detecting apparatus of claim 7, wherein said guide link member is oriented at an angle with respect to a first dimension of said feed cassette and wherein movement of said feed cassette in a direction perpendicular to said first dimension causes said sensor unit to move in a direction parallel to said first dimension.

11. The paper detecting apparatus of claim 10, wherein the position of said guide link member is adjusted to a selected position based on a selected paper size.

12. The paper detecting apparatus of claim 1, wherein said feed cassette has a first dimension and said sensor location varying unit is movable with respect to said feed cassette, and where said sensor unit is movable in a direction substantially parallel to said first dimension of said feed cassette.

13. The paper detecting apparatus of claim 12, wherein said feed cassette is movable in a direction substantially perpendicular to said first dimension.

14. An image forming apparatus comprising:

a main body including a printing engine for forming an image and a feed means for feeding printing papers to the printing engine;

a feed cassette removably mounted in the main body of the image forming apparatus, the feed cassette being capable of being loaded with different sizes of printing paper;

a sensor unit installed in the main body of the image forming apparatus to detect the presence or absence of printing paper, said sensor unit being movably mounted to said main body; and a sensor location varying unit mounted in said feed cassette for varying a location of the sensor unit according to the size of the printing paper such that the sensor unit can detect the printing paper at the rear end portion of the printing paper irrespective of the size of the printing paper loaded in the feed cassette.

15. The image forming apparatus as claimed in claim 14, wherein the sensor location varying unit causes the location of the sensor unit to be varied when the feed cassette is mounted to the image forming apparatus.

16. The image forming apparatus as claimed in claim 15, wherein the sensor location varying unit includes:

a paper guide lever that moves longitudinally according to the length of the printing paper loaded in the feed cassette; and a sensor guide link member with a first and a second end, the sensor guide link member rotating about the first end in association with movement of the paper guide lever, thereby pushing out the sensor unit by contacting the sensor unit when the feed cassette is mounted to the image forming apparatus.

17. The image forming apparatus as claimed in claim 16, wherein the paper guide lever moves substantially parallel to the direction that the feed means feeds the printing paper.

18. The image forming apparatus as claimed in claim 17, wherein the first end of the sensor guide link member is pivotably coupled to an axis on the bottom surface of the feed cassette.

19. The image forming apparatus as claimed in claim 18, wherein a longitudinal guide slit is formed on the second end of the sensor guide link member, and the paper guide lever has a guide protrusion inserted into the guide slit so that the sensor guide link member rotates about the axis depending on the movement of the paper guide lever.

20. The image forming apparatus as claimed in claim 19, wherein the sensor unit includes:

a paper detecting sensor;

a sensor support for supporting the paper detecting sensor and for moving in contact with the sensor guide link member;

a sensor guide rail installed in the main body of the image forming apparatus to guide moving of the sensor support; and an elastic member for elastically biasing the sensor support toward an initial location.

* * * * *